United States Patent [19]

Gummow

[11] 4,406,186

[45] Sep. 27, 1983

[54] DUAL ACTION RATCHET WRENCH

[76] Inventor: Stephen A. Gummow, 1501 Hawthorne Ave., Minneapolis, Minn. 55403

[21] Appl. No.: 268,577

[22] Filed: May 29, 1981

[51] Int. Cl.[3] ..... B25B 13/46

[52] U.S. Cl. ..... 81/60; 81/177.8

[58] Field of Search ..... 81/60–63.2, 81/119, 177 ST, 177.8, 177.9, 177 PP; 403/94, 96, 97

[56] References Cited

U.S. PATENT DOCUMENTS

| | | | |
|---|---|---|---|
| 591,167 | 10/1897 | Hammarstrom | 81/119 |
| 1,000,878 | 8/1911 | Allen | 81/58.5 |
| 1,429,386 | 9/1922 | Watson | 81/58.4 |
| 1,568,442 | 1/1926 | Carver | 81/119 |
| 1,665,944 | 4/1928 | Albertini et al. | 81/62 |
| 2,082,356 | 6/1937 | Rueb | 81/63 |
| 2,420,132 | 5/1947 | Gryniuck | 81/58.3 |
| 2,669,147 | 2/1954 | Koenig | 81/58.3 |
| 2,680,983 | 6/1954 | Miller | 81/60 |
| 2,712,765 | 7/1955 | Knight, Jr. | 81/58.3 |
| 2,834,239 | 5/1958 | Mancini | 81/58.5 |

FOREIGN PATENT DOCUMENTS

| | | | |
|---|---|---|---|
| 1340335 | 9/1963 | France | 81/60 |

OTHER PUBLICATIONS

P. 64, Sears & Roebuck 1980–1981 Fall–Winter Catalog of Power & Hand Tools.

*Primary Examiner*—James L. Jones, Jr.
*Attorney, Agent, or Firm*—Kinney, Lange, Braddock, Westman and Fairbairn

[57] ABSTRACT

A ratchet wrench includes a body which carries a shank adapted to be removably fitted into a socket head for the purpose of rotating a socket head to turn a nut in the socket onto or off of a bolt. A handle pivot pin is mounted on the wrench body at a side opposite the shank to have its axis parallel to and spaced from the axis of the shank. An elongated wrench handle is mounted on the pivot pin and is movable with respect to the wrench body between a first position wherein the handle fits into the wrench body and is thus locked with respect to angular movement between the wrench body and the handle and a second position where it is above and spaced from the wrench body and can rotate freely about the pivot pin to cause the wrench body to rotate freely about the axis of the shank.

11 Claims, 9 Drawing Figures

DUAL ACTION RATCHET WRENCH

BACKGROUND OF THE INVENTION

This invention relates to ratchet wrenches having shanks holding socket heads to install and tighten nuts onto machine bolts and to break loose and remove nuts from machine bolts, for example.

Particularly, the invention relates to a ratchet wrench which can be used in a first configuration to cause force on the wrench handle to be applied directly to the shank to tighten or loosen nuts associated with a socket head on the shank; and can be used in a second configuration wherein the handle can be moved to cause the shank to rotate rapidly to spin the nut on or off of a bolt.

It is known to provide wrenches which can operate in one configuration to apply direct torque to a shank and in another configuration to rapidly rotate the shank under conditions of lesser load. For example, see U.S. Pat. No. 1,429,386 to Watson, issued in September of 1922, which provides a wrench structure by which nuts may be quickly run up or down on a bolt and then loosened or tightly locked into place. A wrench head integral with a lever handle rotatably supports a socket for engaging a nut to be driven. The socket is connected to a shank which is integral with a brace, a first portion of which extends perpendicularly outwardly from the shank, and a second portion of which is pivotably mounted with respect to the outer end of the first portion so that the second portion can be turned up to form a crank thus to rapidly spin the socket and consequently the nut to quickly run the bolt up or run down on a bolt. When the nut is to be tightened or broken loose, the outer portion of the brace is folded outwardly, and the entire brace is situated in parallel relationship and in contact with the handle and both are turned to exert the necessary tightening or loosening torque on the nut. This structure presupposes easy access to the nut and to the bolt for the full 360° circle around the longitudinal axis of the nut and bolt and wrench as well as access for a considerable distance outwardly from the bolt in line with its axis.

In U.S. Pat. No. 2,712,765 to Knight, granted in July of 1955, a wrench shank is integral with a shaft which forms a crank handle, and the opposite end of this shaft is rotatably mounted in a pistol grip. For fast operation, the pistol grip and outer end of the shaft are moved in a circular motion about the longitudinal axis of the shank. This provides a high-speed low-torque arrangement. A jaw clutch operable from inside of the pistol grip freezes the outer end of the crank arm against rotation with respect to the pistol grip, and this provides the so-called high-torque low-speed relationship. This structure will not, of course, allow anything like the torque developed by a conventional socket wrench to be applied. A modification discloses a crank arm arrangement for high speed operation, but both forms of the Knight structure require a substantial clearance in a 360° circle around the longitudinal axis of the shank, as well as very substantial clearance outwardly from the bolt along its longitudinal axis.

In contrast to the above, U.S. Pat. No. 2,680,983 to J. T. Miller, granted in June of 1954, discloses a wrench which can be operated in one configuration to apply torque directly to a shank and associated socket head from a handle or can be operated in another configuration to actually slow down the speed of rotation of the shank and associated socket head through gearing in order to increase the torque applied by the handle.

In a preliminary search on this invention, in addition to the patents set out above, the following patents were located. They are not believed to be particularly pertinent to the invention:

U.S. Pat. No. 1,000,878 to Allen in August of 1911;
U.S. Pat. No. 2,420,132 to Gryniuck in May of 1947;
U.S. Pat. No. 2,669,147 to Koenig in February of 1954;
U.S. Pat. No. 2,834,239 to Mancini in May of 1958.

What was needed before the present invention was a ratchet wrench which could be used directly to exert a tightening or loosening force through a shank and a socket head to tighten or loosen a nut on a bolt, this wrench being operable to rapidly move the bolt onto or off of the nut where there is but limited access to the bolt in the full circle around the bolt and where there is no access to the nut and bolt at any considerable distance away from the bolt in the direction of the longitudinal axis of the bolt.

Another example of a wrench having an adapter to spin a nut on or off of a bolt is shown at page 64 of the Sears & Roebuck 1980-81 Fall-Winter Catalog of Power and Hand Tools. In this ad, a conventional ratchet wrench is equipped with a knurled dial extending outwardly between the wrench head and the shank integral with the shank to permit the shank to be rotated manually. To use this feature, the operator must be able to reach the wrench body with his hand.

Applicant and those in privity with him are aware of no prior art which is closer to this invention than that set out above; and they are aware of no prior art which anticipates the claims made herein.

BRIEF SUMMARY OF INVENTION

A socket wrench includes a wrench body which carries a shank adapted to removably fit into a socket head for the purpose of rotating the socket head to turn a nut in the socket onto or off of a bolt. A handle pivot pin is mounted with respect to the wrench body at a side thereof opposite the shank to have its axis parallel to and spaced from the axis of the shank.

An elongated wrench handle is mounted on the pivot pin and is positionable with respect to the wrench body between a first configuration wherein the handle is in fixed relationship with respect to the wrench body to prevent if from having angualar movement with respect to the wrench body and a second configuration wherein the handle is in clearing relationship with respect to the wrench body on a side of the body opposite the shank and has freedom to pivot full circle around the axis of the pivot pin in a crank arm action to cause the wrench body and shank to rapidly rotate a nut situated in a shank-mounted socket head.

DESCRIPTION OF PREFERRED EMBODIMENTS

Figure 1:
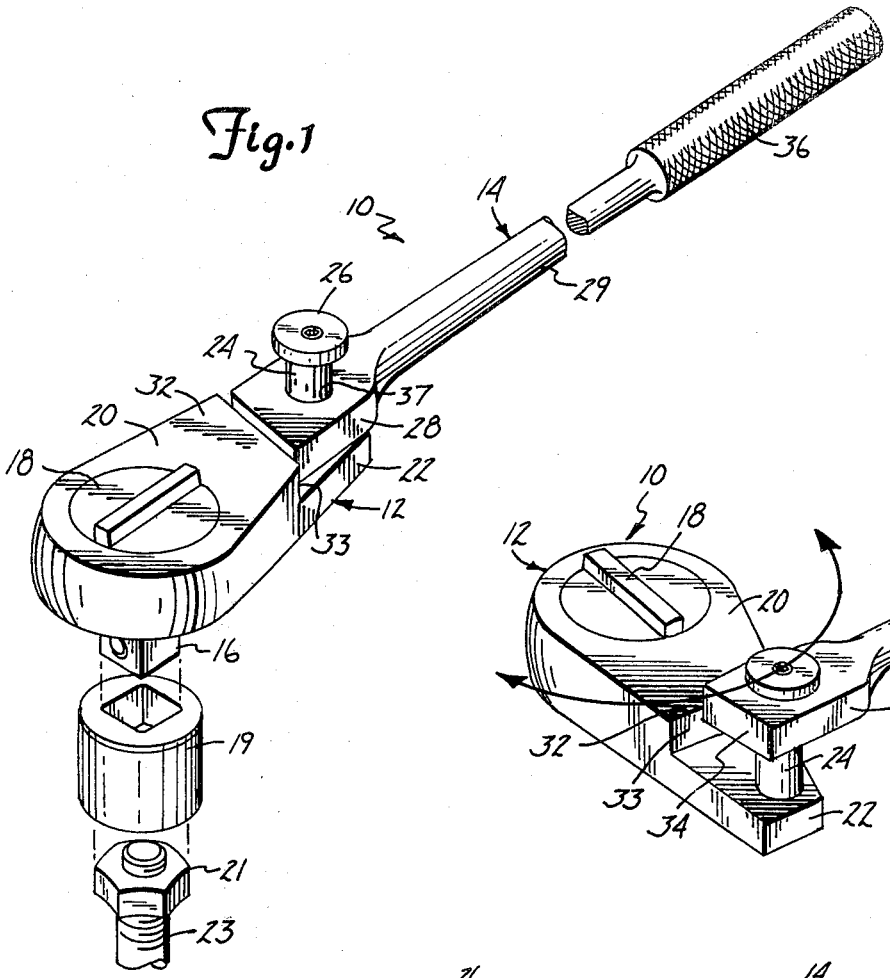
FIG. 1 is a perspective view of a first form of socket wrench made according to the present invention with a wrench handle shown in locked angular relationship with respect to a wrench body.
Figure 2:
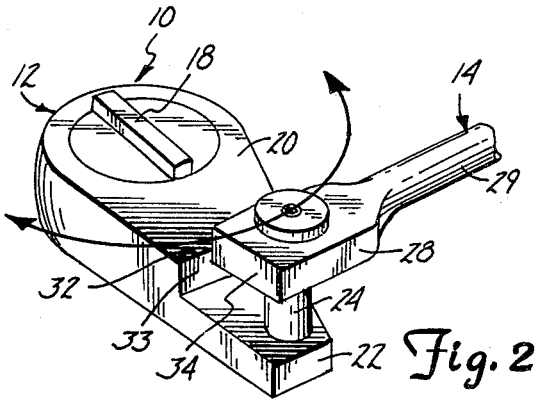
FIG. 2 is a fragmentary perspective view of the wrench of FIG. 1 but with the wrench handle in a position clear of the wrench body to permit the body and handle to pivot full circle with respect to each other about a body-mounted handle-mounting wrench pivot pin.
Figure 3:
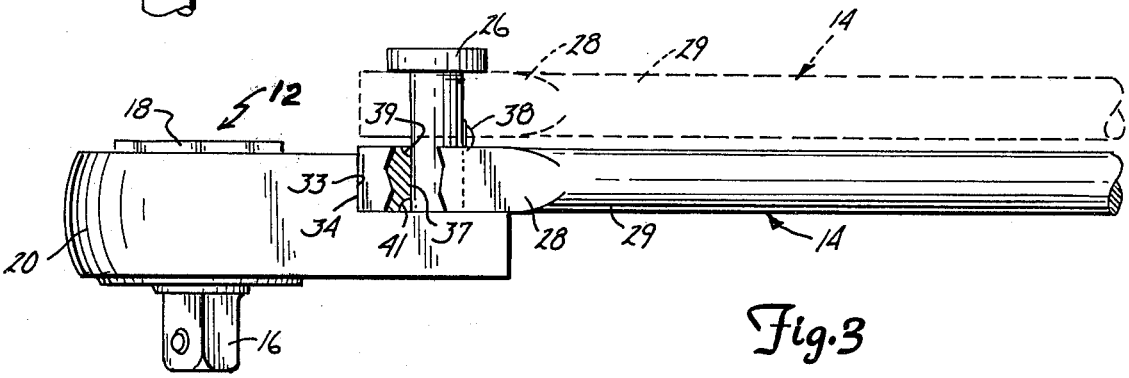
FIG. 3 is a fragmentary side elevational view of the wrench of FIGS. 1 and 2 showing the handle in its locked position with respect to the wrench body.

In the first form of the invention as seen in FIGS. 1 through 3, a socket wrench 10 includes a wrench body 12, a wrench handle 14, and a shank 16 extending downwardly from a central portion of that body. As shown, the wrench is provided with a ratchet mechanism which includes a ratchet direction selector 18 which can be moved between "on", "LOCKED" and "OFF" positions to cause the shank 16 to drive an attached socket head or socket 19 in clockwise direction only, in both directions, or in counterclockwise direction only, respectively. Clockwise movement of the socket head 19 will cause a nut 21 therein to advance on a bolt 23; while counterclockwise movement will cause the nut to retreat.

Wrench body 12 includes a ratchet encompassing case 20 and a neck 22 extending integrally outwardly from the case at a lower portion thereof. The case is provided with a shoulder 32, the shoulder being partially defined by a shoulder face 33 which extends perpendicularly away from an upper surface of the neck 22.

A cylindrical handle pivot pin 24 extends integrally upwardly from a central portion of the upper surface of the neck 22, and an enlarged handle retaining cap 26 extends radially outwardly from the upper end of this pivot pin.

The wrench handle 14 includes an inner enlarged connecting end portion 28, an intermediate shaft or loom portion 29, and an outer gripper end portion 36.

Connecting end portion 28 of the handle 14 is provided with a cylindrical opening 37 therethrough of diameter to fit snugly but freely on the handle pivot pin 24. Provided in this handle pivot pin is a handle positioning spring-loaded detent ball 38. An upper detent groove 39 is provided in the handle where the cylindrical opening 37 meets the upper face of the connecting end portion 28 of the handle, and a lower detent groove 41 is provided where this cylindrical opening 37 meets the lower face of the handle end portion.

In operation, wrench handle 14 is movable from a first position as seen in FIGS. 1 and 3 wherein the handle is locked against angular movement with respect to the wrench body 12 and the shank 16, and a second position, as seen in FIG. 2 and as illustrated in dotted lines in FIG. 3 wherein the handle 14 is in clearing relation with respect to the shank 16 and the wrench body 12 in a horizontal plane and may be freely rotated, full circle, about the handle pivot pin 24 thus to cause the wrench body and shank to rotate full circle about the axis of the shank and a socket head and nut connected thereto.

Figure 4:
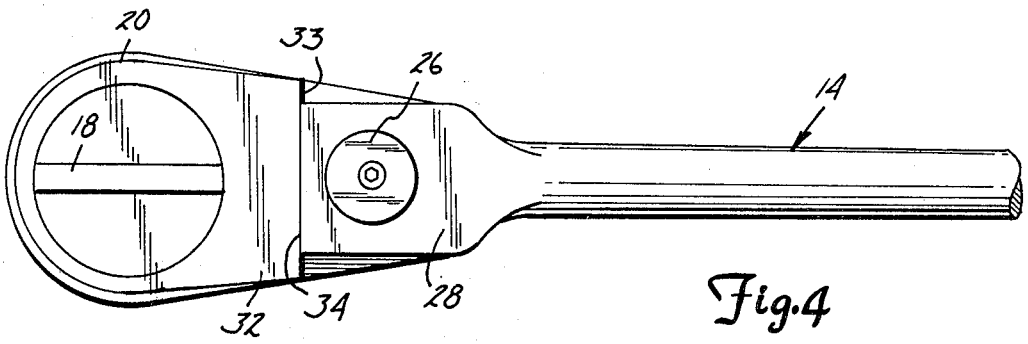
FIG. 4 is a fragmentary top plan view of the wrench of FIG. 3.
Figure 5:
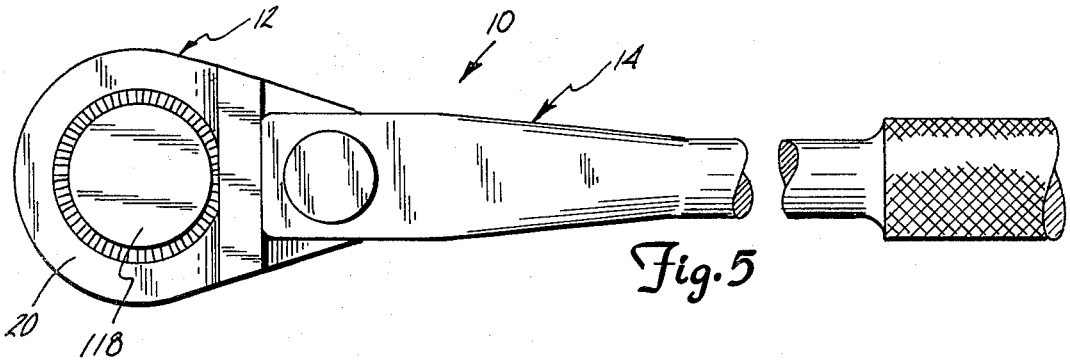
FIG. 5 is a top plan view of a second form of socket wrench made according to the invention.
Figure 6:
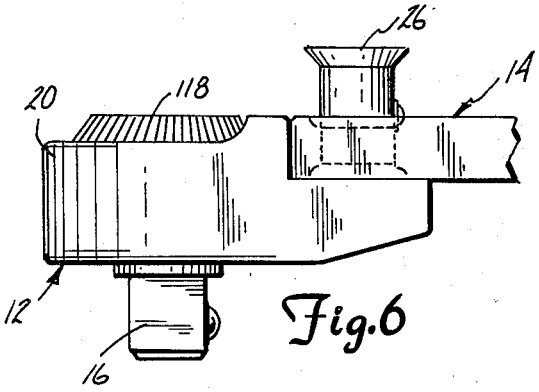
FIG. 6 is a side elevational view of the wrench body and shank and a fragmentary view of the handle of the wrench of FIG. 5 showing the handle in its locked position with respect to the body.
Figure 7:
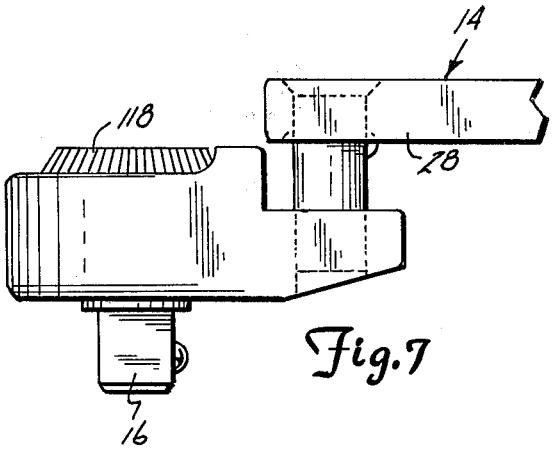
FIG. 7 is a fragmentary side elevational view of the wrench of FIG. 6, but showing the handle in its position in clearing relationship with respect to the wrench body.
Figure 8:
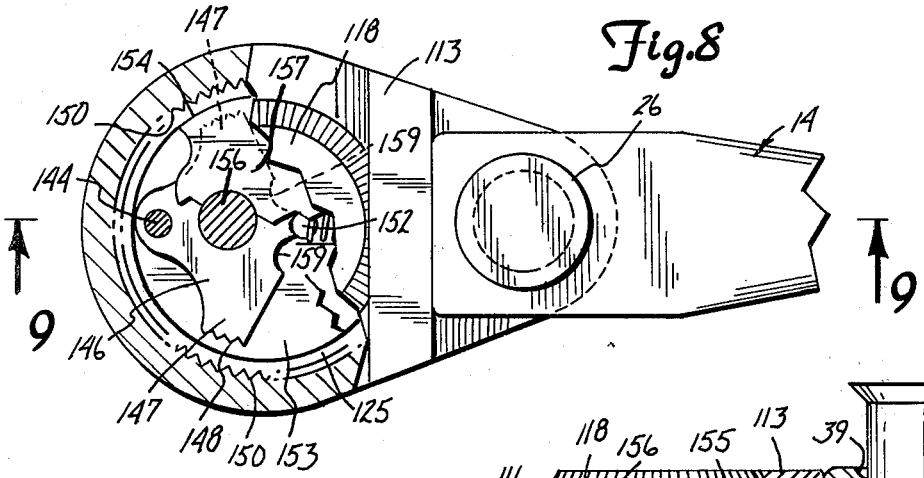
FIG. 8 is an enlarged fragmentary top plan view of the wrench as seen in FIG. 6 with parts in section and parts broken away to disclose parts of the wrench ratchet and selector mechanism.
Figure 9:
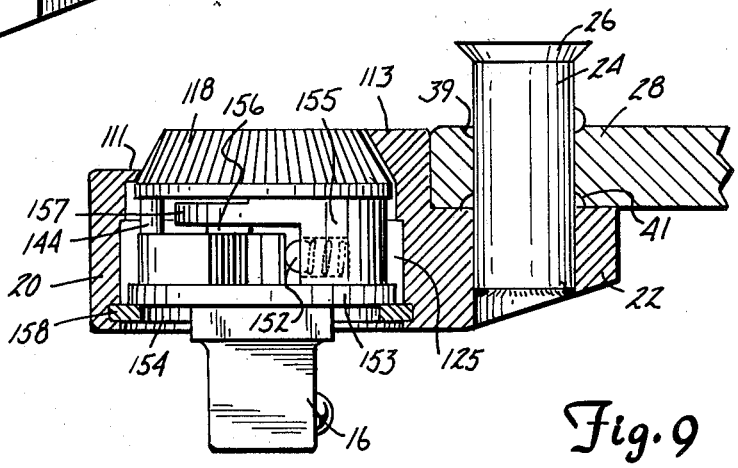
FIG. 9 is a fragmentary vertical sectional view taken substantially on the line 9—9 in FIG. 8.

To render the handle angularly immovable with respect to the wrench body in the shank, the inner end of the connecting end portion 28 of the handle is defined by an end surface 34 which extends in perpendicular relationship to the upper surface of the neck 22 and in parallel relationship to the axis of the pivot pin 24. As seen in FIGS. 1, 3 and 4, this handle end surface 34 is positioned in parallel contacting relationship to the shoulder face 33 of the shoulder of the case 20 of the wrench body 12 when the handle is situated in its first position. When in this position, the detent ball 38 rides in the upper detent groove 39 of the inner connecting end portion 28 of the handle 14 and tends to maintain the handle in this first position. With the handle in this first position, the socket wrench 10 can be utilized as a conventional socket or ratchet wrench by simply adjusting the ratchet direction selector 18 as desired.

To move the wrench handle to its second position, the user can, for example, grip the underside of the handle in adjacent relation to the wrench body 12 with his fingers and the handle retaining cap 26 with his thumb, and exert sufficient force so as to cause the spring-loaded detent ball 38 to retract, allowing the handle to move to the upper or second position as seen in dotted lines in FIG. 2. At the time the upper surface of the inner end portion of the handle comes in contact with the under surface of the handle retaining cap 26, the detent ball 38 will be aligned with the lower detent groove 41 of the inner end portion 28 of the handle. This detent ball will ride freely in the lower detent groove allowing the handle to rotate freely about handle pivot pin 24, but tending to prevent if from moving from second position toward first position.

When in this second position as illustrated in FIG. 2, the handle can be rotated full circle about the handle pivot pin 24 while simultaneously causing the wrench body 12 to rotate full circle about the axis of the shank 16. This positioning will be used to rapidly turn off or turn on a nut such as the nut 21 with respect to a bolt such as the bolt 23 when a socket head 19 is connected to the shank 16 and is in encompassing relationship with respect to the nut.

When the nut meets substantial resistance to turning on the bolt, the user will align the handle so that the shoulder face 33 of the handle body and the end surface 34 of the inner end portion of the handle 14 are in parallel aligned relation, and will push the handle from the second position down to the first position against the action of the detent ball 38. The wrench can then be used as a standard socket wrench or ratchet wrench to apply full direct pressure to rotate the shank 16, socket head 19 and nut 21.

Referring now to FIGS. 5 through 9, a second form of the wrench is disclosed wherein the parts are designed to take less space between the end of a bolt on which a nut is to be installed and an obstruction located in direction away from the longitudinal axis of the bolt and in direction parallel to that axis. In order to accomplish this, may of the basic elements of the wrench as set out is connection with FIGS. 1 through 4 are the same, but some are varied in order to effect a saving in space.

As in the first form of the wrench, a ratchet wrench 10 includes a wrench body 12 having an outwardly extending neck 22 to which a wrench handle 14 is pivotably connected through a handle pivot pin 24. An inner enlarged connecting end portion 28 of the handle 14 is provided with an upper detent groove 39 and a lower detent groove 41 to match up with a handle positioning spring-loaded detent ball 38 extending outwardly from the handle pivot pin 24. To conserve space, an enlarged handle retaining cap 26 is shaped to nest snugly entirely within the upper detent groove 39 when the handle is in its second position, as most clearly seen in FIG. 7.

Also, the upstanding ratchet direction selector 18 of the first form of the invention has been replaced by a knurled ratchet direction selector 118 which is freely rotatable with respect to the wrench body 12. As shown, the selector takes the outer form of a truncated cone, and is retained within the wrench body 12 by lips 111 and 113.

The ratchet encompassing case 20 is provided with a ratchet chamber 125. In that chamber and beneath the direction selector 118, the shank 16 extends integrally downwardly from a shank supporting body 154 which is rotatably mounted in the wrench body 12 and is retained therein by retaining ring 158.

The shank supporting body 154 is C-shape in cross section, and includes a disc-like bottom plate 153, a detent ball positioning block 155 which extends integrally upwardly from the block 155, and an upper pawl positioning pin support plate 157 extending from block 155 in parallel spaced relation to bottom plate 153.

A wrench force transmitting ratchet pawl positioning pin 156 is offset with respect to the longitudinal axis of the shank 16 and of the shank supporting body 154, and is fixedly mounted between the plates 153 and 157 of that body. Ratchet pawl 146 is pivotably mounted on the ratchet pawl positioning pin 156. The pawl has two ratchet arms 147,147, each of which is defined by teeth 148. These teeth are in radial alignment with a complete ring of ratchet teeth 150 provided on an inner surface of the ratchet chamber 125 of the wrench body 12.

Situated inside of and extending out of detent ball positioning block 155 is a pawl positioning spring-loaded detent ball 152. This detent ball 152 is spring-loaded to ride on any one of three detent grooves 159 which are provided in the ratchet pawl 146. With the pawl positioned to receive the detent ball 152 in the middle detent groove 159, neither of the sets of teeth 148 of the ratchet arms 147,147 will be in contact with the rack teeth 150 of the ratchet chamber 125. When the ball 152 is positioned in one of the outer detent grooves 159, the teeth 148 of one of the ratchet arms will be in contact with the teeth 150 to cause the ratchet mechanism to be operable to drive the shank 16 in a clockwise direction; and when the ball is in contact with the opposite outer detent groove 159, the shank will be driven in a counterclockwise direction.

To move the ratchet pawl between these three positions, a pawl selection pin 144 extends integrally upwardly from the pawl 146 into operable contact with the underside of the ratchet direction selector 118. To change the functioning of the ratchet mechanism, the ratchet direction selector 118 is moved selectively between a "clockwise", "neutral", and "counterclockwise" position.

With the ratchet direction selector 118 set in one of the appropriate clockwise or counterclockwise positions, the wrench of the second form of the invention is utilized in exactly the same manner as the wrench of the first form of the invention when it is desired to move from the first position wherein the handle 14 is locked against angular movement with respect to the wrench head 12 and the second position wherein the handle 14 is freely rotatable with respect to that wrench body.

What is claimed:

1. A wrench comprising:

a wrench body having a top and a bottom;

a shank extending downwardly from the bottom of the wrench body for rotatably driving removably attached tools about a first axis;

a handle having a first end for gripping by a user and a second end for transmitting force from the handle to the wrench body; and a pivot pin extending between and connecting the wrench body and the second end of the handle, the pivot pin being aligned along a second axis which is spaced from and parallel to the first axis; wherein the pivot pin extends through and is slidable within a cylindrical opening in one of the wrench body and second end of the handle to permit sliding movement of said one containing the cylindrical opening along the second axis, and wherein the pivot pin is rotatable with respect to the cylindrical opening, so that the wrench body and the second end of the handle are relatively positionable along the second axis in a first engaged force transmitting relationship and a second spaced apart force transmitting relationship; wherein in the first engaged force transmitting relationship the wrench body and the second end are positioned so that at least a portion of the second end of the handle is below a plane which is perpendicular to the first and second axes and is defined by the top of the wrench body, with a surface of the second end engaging a mating surface of the wrench body in a fixed force transmitting relationship; and wherein the pivot pin is of sufficient length so that in the second force transmitting relationship a bottom surface of the second end of the handle is elevated above and spaced apart from the plane defined by the top of the wrench body so that the second end of the handle is freely rotatable about the second axis while the pivot pin and the second end of the handle are freely rotatable in a full circle about the first axis.

2. The wrench of claim 1 wherein:

the surface of the second end which engages the mating surface of the wrench in the first engaged force transmitting relationship includes at least one plane surface at the second end of the handle; and the mating surface of the wrench body includes at least one plane surface adapted to lie in contacting, force transmitting relationship to the plane surface of the second end when the wrench body and the second end are in the first force transmitting relationship.

3. The wrench of claim 2 wherein the pivot pin is fixedly attached to and extends upwardly from the wrench body and wherein the cylindrical opening is in the second end of the handle.

4. The wrench of claim 3 and further comprising:

an enlarged handle retaining cap extending integrally outwardly from an upper end of the pivot pin.

5. The wrench of claim 4 and further comprising:

a spring-loaded detent member extending radially outwardly from a central portion of the pivot pin;

a first detent groove in the second end of the handle open to the cylindrical opening and positioned to receive the spring-loaded detent member when the wrench body and the second end are in the second force transmitting relationship to thereby tend to prevent the handle from moving along the second axis from the second relationship to the first relationship without application of a substantial external force on the handle.

6. The wrench of claim 5 and further comprising:

a second detent groove in the second end for receiving the spring-loaded detent member when the wrench body and the second end are in the first relationship to tend to prevent the handle from moving along the second axis toward the second relationship.

7. The wrench of claim 6 wherein the enlarged handle retaining cap is shaped to fit within second detent groove when the wrench body and the second end are in the second relationship.

8. The wrench of claim 1 and further comprising:

a ratchet mechanism situated in a ratchet chamber in the wrench body and operably connected to the shank, and having a rotatable ratchet direction selector exposed at the second side of the wrench body.

9. The wrench of claim 8 wherein the ratchet direction selector is a flat, circular member mounted for rotation about the first axis, the ratchet direction selector having a top surface which is generally coplanar with the second side of the wrench body and having a edge which is at least partially exposed to allow rotation of the ratchet direction selector by application of force to the exposed edge of the ratchet direction selector.

10. The wrench of claim 9 and further comprising:

a shank supporting body for integrally supporting the shank to be rotatable about the first axis relative to the wrench body, the shank supporting body defining a pawl positioning cavity;

a pawl positioning pin mounted in the shank supporting body and extending into the pawl positioning cavity;

a ratchet pawl pivotably mounted on the pawl positioning pin in the cavity and having at least one toothed ratchet arm;

a ring of ratchet teeth extending around an interior surface of the ratchet chamber in a plane normal to the axis of the shank and in operational alignment with the pawl teeth;

means for selectively retaining the pawl in position to hold the toothed ratchet arm either into operational contact with the ratchet chamber ratchet teeth or out of contact therewith depending upon a rotational position of the ratchet direction selector.

11. A wrench comprising:

a wrench body having a top and a bottom;

a shank extending downwardly from the bottom of the wrench body for rotatably driving removably attached tools about a first axis;

a pivot pin having a lower end and an upper end, the pivot pin being attached at its lower end to the wrench body and extending upwardly to its upper end which is located above the top of the wrench body, the pivot pin defining a second axis which is spaced from and parallel to the first axis; and a handle having a first end for gripping by a user and a second end for connection to the wrench body, the handle having a cylindrical opening at its second end through which the pivot pin extends and being slidable on the pivot pin along the second axis between a first position adjacent the lower end of the pivot pin, in which the wrench body and the second end of the handle are positioned so that at least a portion of the second end of the handle is below a plane which is perpendicular to the first and second axes and is defined by the top of the wrench body, with a surface of the second end engaging a mating surface of the wrench body so that the handle and the wrench body are in a fixed engaged force transmitting relationship, and a second position adjacent the upper end of the pivot pin in which the handle is elevated with respect to the top of the wrench body so that a bottom surface of the second end of the handle is elevated with respect to the top of the wrench body and the second end of the handle is freely rotatable about the pivot pin while the pivot pin and the second end of the handle are freely rotatable in a full circle about the first axis.

* * * * *